US009750392B2

(12) United States Patent
Bewley, Jr. et al.

(10) Patent No.: US 9,750,392 B2
(45) Date of Patent: Sep. 5, 2017

(54) DISHWASHER APPLIANCE AND VENT FOR SAME

(71) Applicant: General Electric Company, Schenectady, NY (US)

(72) Inventors: Wilbur Carl Bewley, Jr., Nicholasville, KY (US); Paul Edward Newsom, II, Louisville, KY (US); Aaron Daniel Mink, Gambrills, MD (US)

(73) Assignee: HAIER US APPLIANCE SOLUTIONS, INC., Wilmington, DE (US)

( * ) Notice: Subject to any disclaimer, the term of this patent is extended or adjusted under 35 U.S.C. 154(b) by 356 days.

(21) Appl. No.: 14/192,910

(22) Filed: Feb. 28, 2014

(65) Prior Publication Data

US 2015/0245760 A1 Sep. 3, 2015

(51) Int. Cl.

| | |
|---|---|
| ***F24C 5/04*** | (2006.01) |
| ***A47L 15/48*** | (2006.01) |
| ***A47L 15/42*** | (2006.01) |

(52) U.S. Cl.

CPC ..... *A47L 15/488* (2013.01); *A47L 15/4257* (2013.01)

(58) Field of Classification Search

CPC ..... A47L 15/4257; A47L 15/488
USPC ..... 454/237, 310, 358, 47, 184, 275–283, 454/367, 368, 49
See application file for complete search history.

(56) References Cited

U.S. PATENT DOCUMENTS

| | | | | |
|---|---|---|---|---|
| 2,021,086 | A * | 11/1935 | Oskamp | F04D 25/12 415/208.2 |
| 3,011,422 | A * | 12/1961 | Scallon | F24F 13/075 454/280 |
| 4,184,500 | A | 1/1980 | Herbst | |
| 4,188,732 | A | 2/1980 | Quayle | |
| 5,660,195 | A | 8/1997 | Taylor, Jr. et al. | |
| 6,921,328 | B1 * | 7/2005 | Nohara | H05K 7/20172 165/80.3 |
| 7,556,049 | B2 | 7/2009 | Oakes et al. | |
| 8,313,583 | B2 | 11/2012 | May et al. | |
| 2003/0026074 | A1 * | 2/2003 | Clements | H05K 7/20181 361/695 |

(Continued)

FOREIGN PATENT DOCUMENTS

WO WO 2013/025668 2/2013

*Primary Examiner* — Avinash Savani
*Assistant Examiner* — Vivek Shirsat
(74) *Attorney, Agent, or Firm* — Dority & Manning, P.A.

(57) ABSTRACT

Dishwasher appliances and vents for dishwasher appliances are provided. The dishwasher appliance includes a chamber for the receipt of articles for cleaning, and a door for selectively opening and closing the dishwasher appliance, the door having an interior wall and a bottom. The dishwasher appliance further includes a conduit disposed within the door. The dishwasher appliance further includes a vent for controlling the egress of fluid from the chamber through the first end, the vent received into the door. The vent includes a generally planer body, and a plurality of aperture assemblies defined in the body. Each of the plurality of aperture assemblies extends generally radially within the plane. The vent further includes a plurality of ribs extending from the body.

8 Claims, 5 Drawing Sheets

(56) References Cited

U.S. PATENT DOCUMENTS

| | | | | |
|---|---|---|---|---|
| 2011/0126864 | A1* | 6/2011 | Kim | A47L 15/486<br>134/25.2 |
| 2013/0008474 | A1 | 1/2013 | Thayyullathil et al. | |

* cited by examiner

FIG. –1–

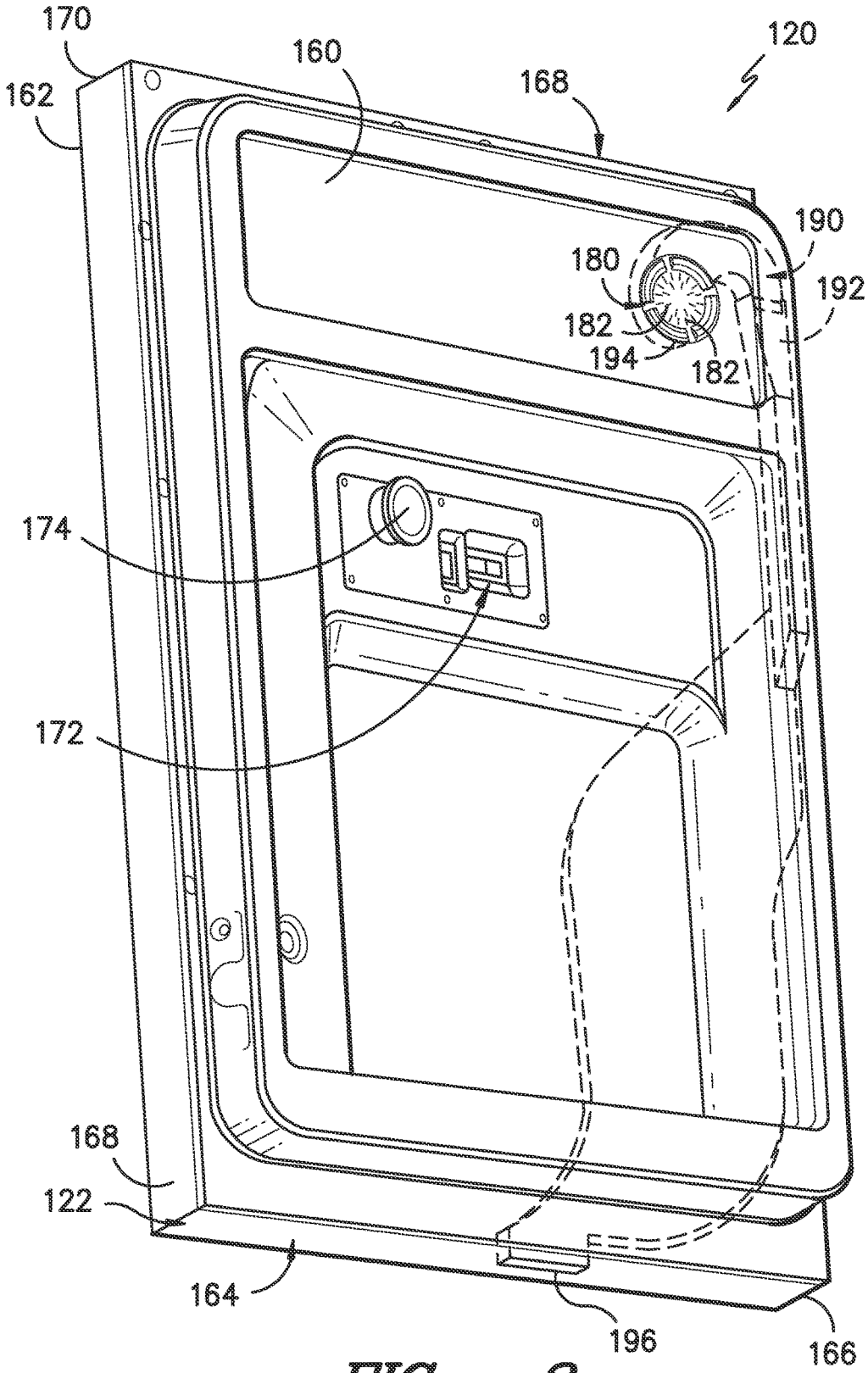
FIG. —3—

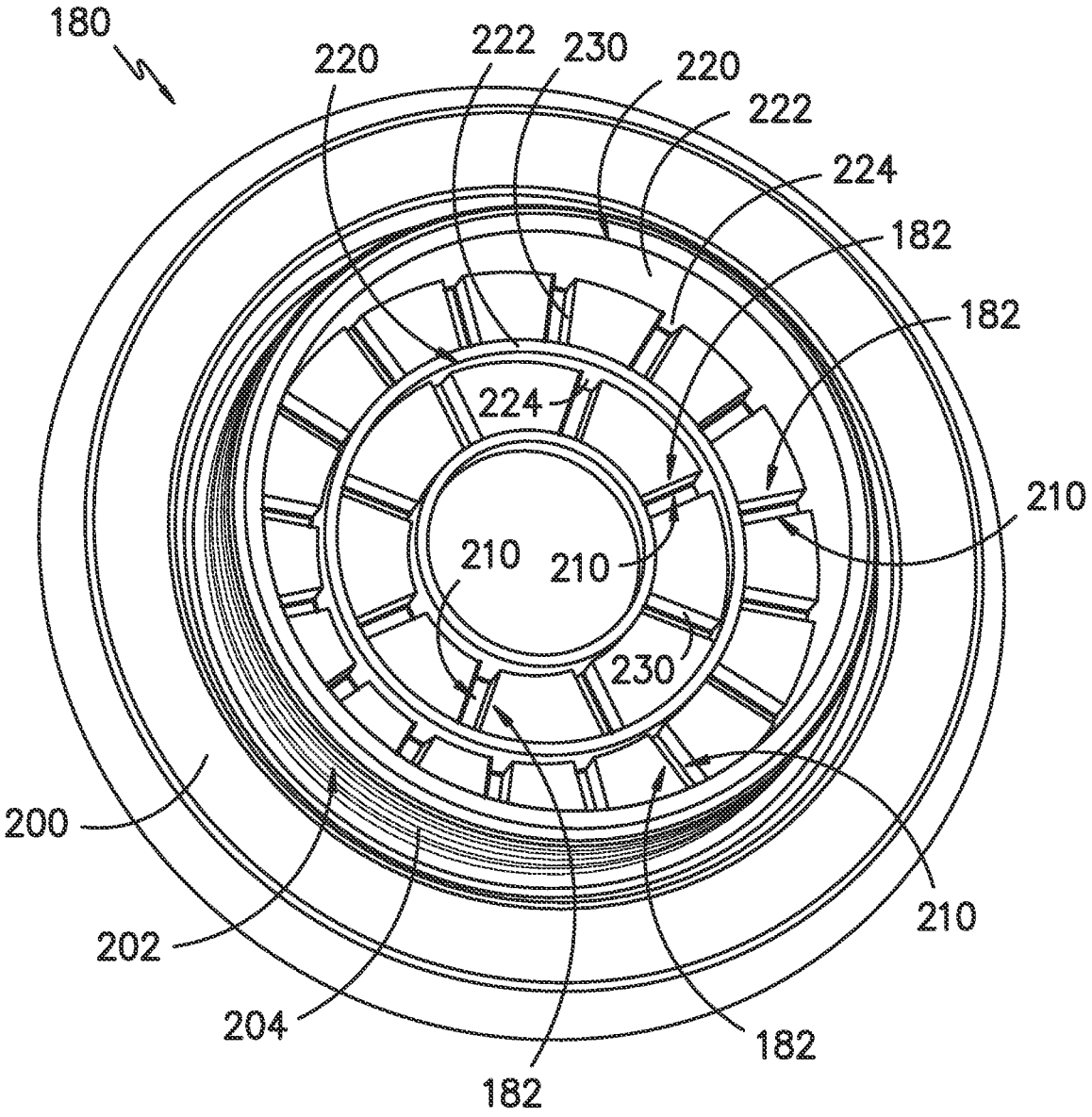
FIG. —4—

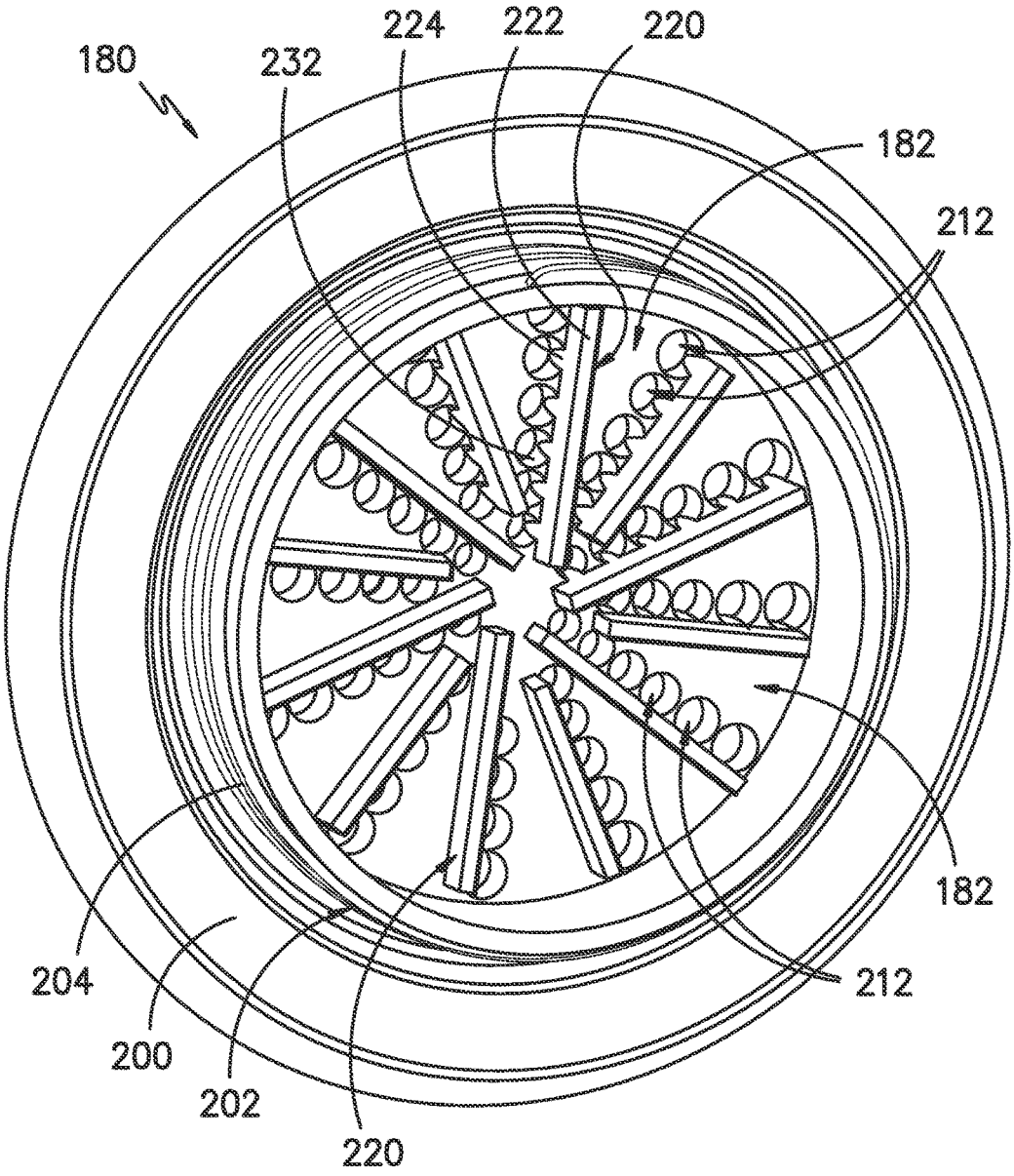
FIG. —5—

DISHWASHER APPLIANCE AND VENT FOR SAME

FIELD OF THE INVENTION

The present disclosure relates generally to dishwasher appliances, and more particularly to vents for use with dishwasher appliances.

BACKGROUND OF THE INVENTION

Modern dishwashers typically include a wash chamber where e.g., detergent, water, and heat can be applied to clean food or other materials from dishes and other articles being washed. Various cycles may be included as part of the overall cleaning process. For example, a typical, user-selected cleaning option may include a wash cycle and rinse cycle (referred to collectively as a wet cycle), as well as a drying cycle. A pre-wash cycle may also be included as part of the wet cycle, and may be automatic or an option for particularly soiled dishes.

In one or more of these cycles, particularly during the drying cycle, it may be desirable to allow heated fluid—typically steam—to be vented from the wash chamber. Such venting allows e.g., for the removal of moisture from the dishes and helps dissipate heat from the drying cycle. Conversely, it is also desirable to retain fluids and heat during other parts of the cleaning process. For example, during the wet cycle, cleaning can be improved by keeping the wash chamber sealed so as to retain heat energy while a heated mixture of water and detergent is sprayed against the dishes and other articles. Maintaining a closed chamber during the pre-wash and wash cycle can also be necessary in order to prevent fluid from being ejected.

Conventionally, one or more vents have been provided near the top of the front door of the dishwasher to allow for the escape of fluid from the wash chamber. In some cases, active vents are utilized. The flow of fluid through such active vents is commonly controlled through a curtain or other cover that is driven by a motor connected through a drive mechanism. The motor must be electrically powered and activated at appropriate times during the cleaning process. As such, this conventional configuration typically adds expense to the manufacture and maintenance of a dishwashing appliance.

Accordingly, in other cases, passive vents are utilized. The flow of fluid through such passive vents is passively controlled based on the configuration of the vents, such as the sizes of the holes defined in the vent. During the wet cycle, water sheets the holes and prevents fluid flow through the vent. During the drying cycle, fluid is allowed to flow through the vent due to the lack of sheeting.

One issue with known passive vent designs is that the surface tension of the water that sheets the holes must be overcome for the water to drain and the holes to open. In some known vent designs, the surface tension of the water can result in the holes remaining sheeted for extended periods of time, such as hours, after venting is desired. One solution to improve the drainage of such vents has been to add vertically extending ribs to the vent, which extend between the horizontally extending vent holes. The ribs facilitate water flow from the holes and thus allow proper water drainage. However, optimal operation of this vent design only occurs when the ribs are positioned vertically. Because vents are typically screwed into dishwasher appliance doors, it is difficult and time consuming to properly orient these vents.

Accordingly, improved vent designs for dishwasher appliances are desired. In particular, passive vents which provide improved liquid flow from apertures thereof, regardless of the orientation of the vent, would be advantageous.

BRIEF DESCRIPTION OF THE INVENTION

Aspects and advantages of the invention will be set forth in part in the following description, or may be obvious from the description, or may be learned through practice of the invention.

In accordance with one embodiment of the present disclosure, a dishwasher appliance is provided. The dishwasher appliance includes a chamber for the receipt of articles for cleaning, and a door for selectively opening and closing the dishwasher appliance, the door having an interior wall and a bottom. The dishwasher appliance further includes a conduit disposed within the door, the conduit defining a passage extending between a first end and a second end, the first end defined in the interior wall for the egress of fluid from the chamber, the second end defined in the door for the egress of fluid from the conduit. The dishwasher appliance further includes a vent for controlling the egress of fluid from the chamber through the first end, the vent received into the door. The vent includes a generally planer body, and a plurality of aperture assemblies defined in the body. Each of the plurality of aperture assemblies extends generally radially within the plane. The vent further includes a plurality of ribs extending from the body.

In accordance with another embodiment of the present disclosure, a vent for a dishwasher appliance is provided. The vent includes a generally planer body, and a plurality of aperture assemblies defined in the body. Each of the plurality of aperture assemblies extends generally radially within the plane. The vent further includes a plurality of ribs extending from the body.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 3 provides a perspective view of the inside of a door of a dishwasher appliance in accordance with one embodiment of the present disclosure;

FIG. 4 provides a perspective view of a vent for a dishwasher appliance in accordance with one embodiment of the present disclosure; and FIG. 5 provides a perspective view of a vent for a dishwasher appliance in accordance with another embodiment of the present disclosure.

DETAILED DESCRIPTION OF THE INVENTION

Figure 1:
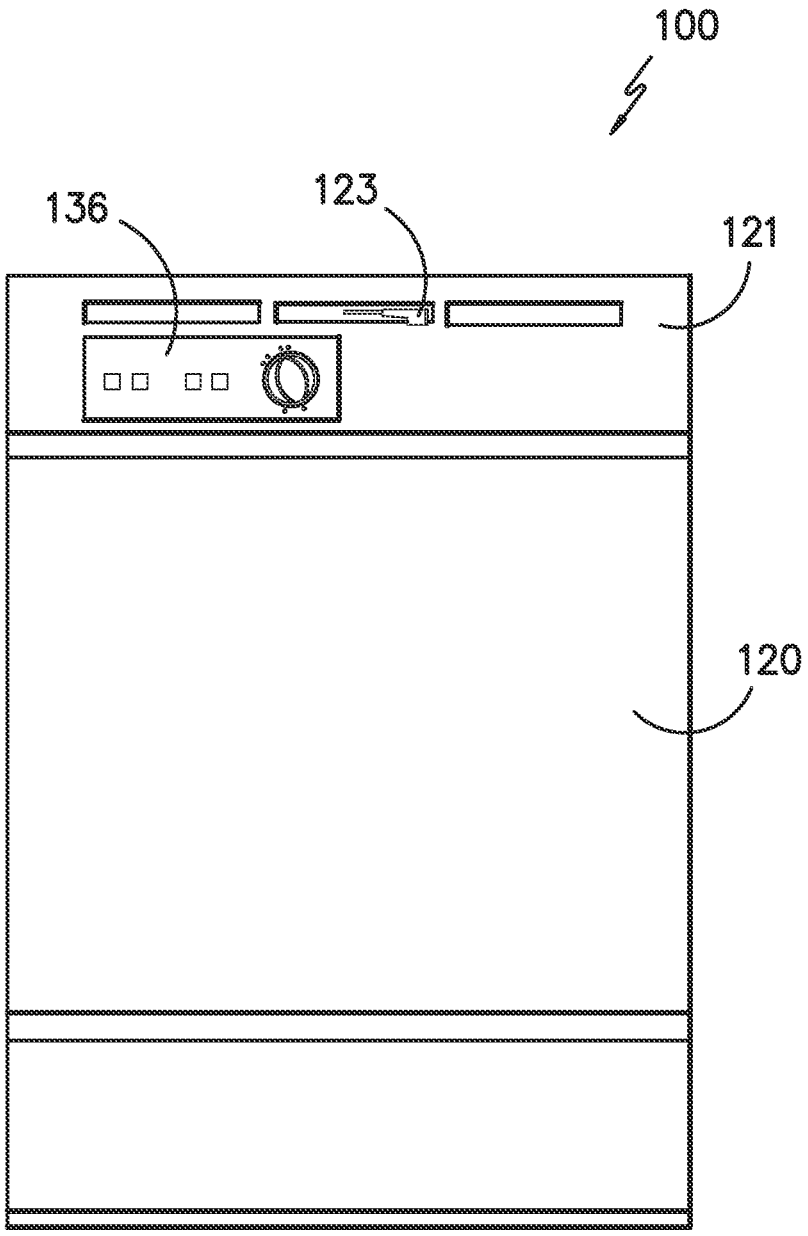
FIG. 1 provides a front, perspective view of a dishwasher appliance in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
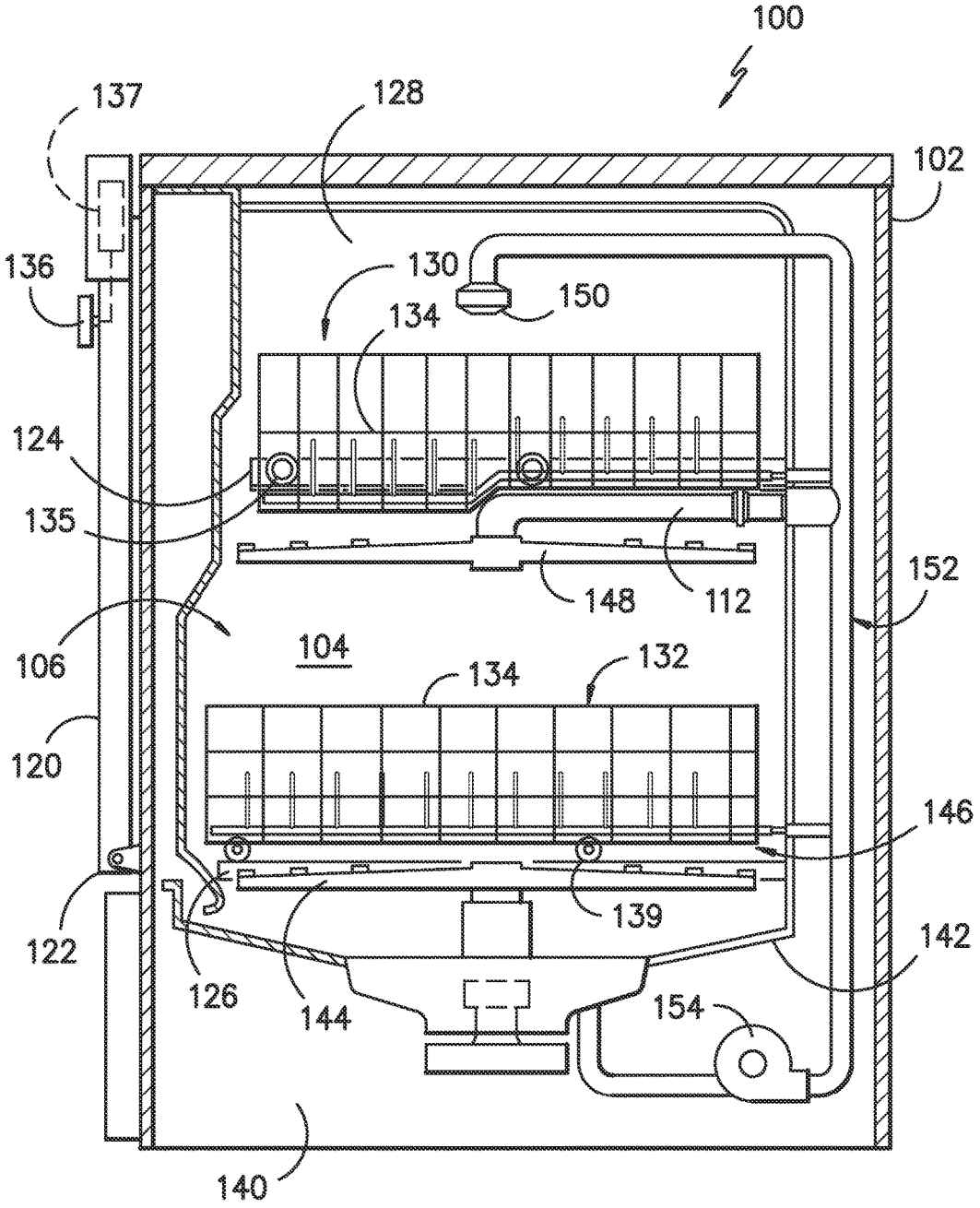
FIG. 2 provides a side, cross-sectional view of a dishwasher appliance in accordance with one embodiment of the present disclosure.

FIGS. 1 and 2 depict an exemplary domestic dishwasher appliance 100 that may be configured in accordance with aspects of the present disclosure. For the particular embodiment of FIG. 2, the dishwasher appliance 100 includes a cabinet 102 having a tub 104 therein that defines a wash chamber 106. Chamber 106 is configured for the receipt of articles for cleaning, such as dishes, cups, utensils, etc. The tub 104 includes a front opening (not shown) and a door 120 hinged at or near its bottom 122 for movement between a normally closed vertical position (shown in FIGS. 1 and 2), wherein the wash chamber 106 is sealed shut for washing operation, and a horizontal open position for loading and unloading of articles from the dishwasher appliance 100. Latch 123 may in some embodiments be used to lock and unlock door 120 for access to chamber 106.

Upper and lower guide rails 124, 126 are mounted on tub side walls 128 and accommodate roller-equipped rack assemblies 130 and 132. Each of the rack assemblies 130, 132 may be fabricated into lattice structures including a plurality of elongated members 134 (for clarity of illustration, not all elongated members making up assemblies 130 and 132 are shown in FIG. 2). Each rack 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by rollers 135 and 139, for example, mounted onto racks 130 and 132, respectively. A silverware basket (not shown) may be removably attached to rack assembly 132 and/or 130 for placement of silverware, utensils, and the like, that are otherwise too small to be accommodated by the racks 130, 132.

The dishwasher appliance 100 further includes a lower spray-arm assembly 144 that is rotatably mounted within a lower region 146 of the wash chamber 106 and above a tub sump portion 142 so as to rotate in relatively close proximity to rack assembly 132. A mid-level spray-arm assembly 148 is located in an upper region of the wash chamber 106 and may be located in close proximity to upper rack 130. Additionally, an upper spray assembly 150 may be located above the upper rack 130.

The lower and mid-level spray-arm assemblies 144, 148 and the upper spray assembly 150 are fed by a fluid circulation assembly 152 for circulating water and dishwasher fluid in the tub 104. The fluid circulation assembly 152 may include a pump 154 located in a machinery compartment 140 located below the bottom sump portion 142 of the tub 104, as generally recognized in the art. Each spray-arm assembly 144, 148 includes an arrangement of discharge ports or orifices for directing washing liquid onto dishes or other articles located in rack assemblies 130 and 132. The arrangement of the discharge ports in spray-arm assemblies 144, 148 provides a rotational force by virtue of washing fluid flowing through the discharge ports. The resultant rotation of the lower spray-arm assembly 144 provides coverage of dishes and other dishwasher contents with a washing spray.

The dishwasher 100 is further equipped with a controller 137 to regulate operation of the dishwasher 100. The controller may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher 100. In the illustrated embodiment, the controller 137 may be located within a control panel area 121 of door 120 as shown. In such an embodiment, input/output ("I/O") signals may be routed between the control system and various operational components of dishwasher 100 along wiring harnesses that may be routed through the bottom 122 of door 120. Typically, the controller 137 includes a user interface panel 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

In general, dishwasher appliance 100 may utilize a variety of cycles to wash and, optionally, dry articles within chamber 106. For example, a wet cycle is utilized to wash articles. The wet cycle may include a main wash cycle and a rinse cycle, as well as an optional pre-wash cycle. During each such cycle, water or another suitable liquid may be utilized in chamber 106 to interact with and clean articles therein. Such liquid may, for example, be directed into chamber 106 from lower and mid-level spray-arm assemblies 144, 148 and the upper spray assembly 150. The liquid may additionally mix with, for example, detergent or other various additives which are released into the chamber during various sub-cycles of the wet cycle. A drying cycle may be utilized to dry articles after washing. During a drying cycle, for example, a heating element (not shown) may heat the chamber 106 to facilitate drying of the articles and evaporation of liquid within the chamber 106. In generally, no liquid is sprayed or otherwise produced during the drying cycle.

It should be appreciated that the invention is not limited to any particular style, model, or other configuration of dishwasher, and that the embodiment depicted in FIGS. 1 and 2 is for illustrative purposes only. For example, instead of the racks 130, 132 depicted in FIG. 1, the dishwasher 100 may be of a known configuration that utilizes drawers that pull out from the cabinet and are accessible from the top for loading and unloading of articles. Other configurations may be used as well.

FIG. 3 provides a perspective view of door 120. Door 120 includes a bottom 122 (which is typically hollow, but may alternatively include a wall) as well as an interior wall 160 and an exterior wall 162. The interior wall 160 and exterior wall 162 define a door interior 164 therebetween. Door 120 additionally includes a left side wall 166, right side wall 168, and top side wall 170, as illustrated. Further, by way of example, door 120 includes a tray 172 for the receipt of dishwashing detergent and a compartment 174 for rinse cycle additives.

In exemplary embodiments, door 120 is formed from an inner door section and an outer door section. The inner door section includes the interior wall 160, while the outer door section includes the exterior wall 162. The inner and outer door sections are fastened together to form the door 120, and to define the interior 164 between the walls 160, 162.

Referring still to FIG. 3, a vent 180 may be provided and received into the door 120, such as into the interior wall 160, for controlling the egress of fluid from the chamber 106. Vent 180 may be located near top side wall 170 and/or at any suitable location on the door 120. Vent 180 may include one or more apertures assemblies 182 defined in vent 180 through which a fluid such as e.g., steam or air may flow to escape from chamber 106.

In exemplary embodiments, vent 180 is a passive vent. In these embodiments, no active mechanical or electronic mechanisms are utilized to control vent 180 and aperture assembly 182 opening and closing to control the egress of fluid therethrough. Rather, such control is provided passively based, for example, on the size, shape, number and positioning of aperture assemblies 182. For example, during the wet cycle, liquid contacting the vent 180 may sheet the vent 180, thus covering the aperture assemblies 182 with a sheet of liquid and preventing the egress of fluid therethrough. During the drying cycle, no sheeting occurs and the aperture assemblies 182 are thus not covered, so fluid may egress through aperture assemblies 182. In alternative embodiments, vent 180 may be an active vent, and various mechanical and/or electronic mechanisms, as are generally known in the art, may be utilized to control vent 180 and aperture assemblies 182 opening and closing to control the egress of fluid therethrough. Such mechanical and/or electronic mechanisms may, for example, be in communication with controller 137, and may actuate based on signals from the controller 137 to selectively prevent or allow egress of fluid through apertures 182.

Referring still to FIG. 3, a conduit 190 may be disposed within the door 120. Conduit 190 may provide a path for the flow of fluid that passes through vent 180 to be exhausted from the dishwasher appliance 100. Conduit 190 may, for example, define a passage 192 extending between a first end 194 and a second end 196, each of which is an opening for access to the passage 192. The first end 194 may, for example, be defined in the door 120, such as in the interior wall 160 thereof, and may be provided for the egress of fluid from the chamber 106. Vent 180 may generally cover and be received in or on the first end 194, such that fluid that flows through apertures 182 further flows through first end, egressing from chamber 106 into conduit 190. The second end 196 may additionally be defined in the door 120 and provided for the egress of fluid from the conduit 190. Second end 196 may, for example, be defined proximate, such as within the area defining, the bottom 122 of the door 120. Accordingly, fluid may flow through apertures 182 into passage 192 of conduit 190, and from passage 192 through second end 196 to exterior of the dishwasher appliance 100.

In some embodiments, conduit 190 is a separate component from the inner door section and outer door section. Alternatively, conduit 190 may be integral with the inner door section, or the outer door section.

Referring now to FIGS. 4 and 5, various embodiments of vent 180 are illustrated. As discussed, vent 180 in exemplary embodiments is a passive vent 180. Accordingly, vents 180 according to the present disclosure advantageously facilitate the quick and efficient flow of liquid from aperture assemblies 182 thereof during dishwasher appliance 100 operation after completion of the wet cycle. Thus, dry cycle venting of the dishwasher appliance 100 is improved. Additionally, vents 180 according to the present disclosure facilitate such quick and efficient liquid flow without regard to the orientation of the vents 180 as installed in the associated dishwasher appliances 100.

As illustrated, a vent 180 according to the present disclosure includes a generally planer body 200. The body 200 in exemplary embodiments is generally circular, as illustrated. Alternatively, however, the body 200 may be oval, rectangular, or have any other suitable shape. Connectors may extend from the body 200 to connect the vent 180 to the door 120. For example, as illustrated vent 180 may include a threaded member 202 having threads 204 which mate with mating threads (not shown) of a receiving bore, such as first end 194.

As mentioned, vent 180 may further include a plurality of aperture assemblies 182. Each aperture assembly 182 may be defined in the body 200. Further, as illustrated, each aperture assembly 182 may extend generally radially within the plane defined by the planer body 200. Accordingly, each aperture assembly 182 may be oriented to generally diverge from a centerpoint of the body. It should be noted that body 200 need not be circular for aperture assemblies 182 to extend radially within the plane, although circular bodies are utilized in exemplary embodiments.

Referring to FIG. 4, in some embodiments, aperture assemblies 182 each include a slot 210. In exemplary embodiments, the slot 210 may have a generally rectangular cross-sectional shape, as illustrated. The slot 210 may thus extend generally radially, such that for example a major side of the rectangle is aligned radially within the plane.

Referring to FIG. 5, in alternative embodiments, aperture assemblies 182 each include a plurality of bore holes 212, which may be aligned in a generally linear array to form an aperture assembly 182. In exemplary embodiments, each bore hole 212 may have a generally circular cross-sectional shape. The linear array of bore holes 212 may thus extend generally radially, such that for example the orientation of the linear array is aligned radially within the plane.

Referring again to FIGS. 4 and 5, a vent 180 according to the present disclosure may further include a plurality of ribs 220. Each rib 220 may extend from the body 180. Ribs 220 may generally facilitate the quick and efficient drainage of liquid from the aperture assemblies 182 when desired, such as after a wet cycle and/or at the commencement of a drying cycle.

For example, each rib 220 may include a rib body 222 and one or more protrusions 224. The rib body 222 may extend from the body 200, such as generally towards and into the passage 192 when the vent 180 is received in the door 120. Each protrusion 224 from the rib body 222 into one of the plurality of aperture assemblies 182, such as into a slot 210

(FIG. 4) or bore hole 212 (FIG. 5) thereof. Further, each protrusion may at least partially form a sidewall of that aperture assembly 182.

For example, as illustrated in FIG. 4, a slot 210 may include one or more sidewalls 230, such as a plurality of sidewalls 230 as illustrated. Protrusion 224 may form one of the plurality of sidewalls 230. In alternative embodiments, as illustrated in FIG. 5, a bore hole 212 may include one or more sidewalls 232, such as a single continuous sidewall 232 as illustrated. Protrusion 224 may form a portion of the sidewall 232.

In exemplary embodiments, the protrusions 224 are integral with the rib body 222. Alternatively, protrusions 224 may be separate components from the rib body 222 that are suitably connected thereto (such as via a suitable adhesive). Further, in exemplary embodiments, the protrusions 224 and/or rib bodies 222 are integral with the body 200. Alternatively, protrusions 224 and/or rib bodies 222 may be separate components from the body 200 that are suitably connected thereto (such as via a suitable adhesive).

Ribs 220, and specifically the rib bodies 222 thereof, may have any suitable shapes. For example, as illustrated in FIG. 4, in some embodiments, a rib body 222 may be generally curvilinear, such as generally circular. FIG. 4 thus illustrates a plurality of arrays of generally radially extending slots 210 (two are shown), each array surrounded by one or more ribs 220 having curvilinear rib bodies 222. As illustrated in FIG. 5, in other embodiments, a rib body 222 may be generally linear. FIG. 5 thus illustrates a plurality of linear arrays of bore holes 212 and a plurality of ribs 220 having linear rib bodies 222, each rib body generally extending parallel to the associated array of bore holes 212.

The radial orientation of the aperture arrays 182 of vents 180 according to the present disclosure advantageously facilitates quick and efficient liquid drainage therefrom regardless of the orientation of the vents 180. Further, the use of ribs 220 having protrusions 224 which form at least portions of sidewalls of the aperture arrays 182 facilitates quick and efficient liquid drainage by providing a path for the liquid to drain from the aperture arrays 182, such that surface tension issues are minimized.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance, comprising:

a chamber for the receipt of articles for cleaning;

a door for selectively opening and closing the dishwasher appliance, the door having an interior wall and a bottom;

a conduit disposed within the door, the conduit defining a passage extending between a first end and a second end, the first end defined in the interior wall for the egress of fluid from the chamber, the second end defined in the door for the egress of fluid from the conduit; and a passive vent for controlling the egress of fluid from the chamber through the first end, the vent received into the door, the vent comprising:

a planar body defining a plane;

a plurality of aperture assemblies defined in the body, each aperture assembly of the plurality of aperture assemblies oriented to diverse from a centerpoint of the body and comprising a plurality of apertures extending radially within the plane, each of the apertures opening into the planar body in a first direction through the planar body; and a plurality of ribs extending away from the body out of the plane in a second direction, the second direction opposing the first direction, wherein each rib of the plurality of ribs comprises a rib body extending from the planar body and a plurality of protrusions, each of the plurality of protrusions extending from the rib body into a respective one of the plurality of aperture assemblies and at least partially forming a sidewall of the respective one of the plurality of aperture assemblies.

2. The dishwasher appliance of claim 1, wherein the rib body of each of the plurality of ribs is linear.

3. The dishwasher appliance of claim 1, wherein the rib body of each of the plurality of ribs is curvilinear.

4. The dishwasher appliance of claim 1, wherein the protrusion of each of the plurality of ribs is integral with the rib body.

5. The dishwasher appliance of claim 1, wherein each aperture of the plurality of aperture assemblies comprises a slot.

6. The dishwasher appliance of claim 5, wherein each of the plurality of slots has a rectangular cross-sectional shape.

7. The dishwasher appliance of claim 1, wherein each aperture of the plurality of aperture assemblies comprises a bore hole, the bore holes of each aperture assembly aligned in a linear array.

8. The dishwasher appliance of claim 7, wherein each of the plurality of bore holes has a circular cross-sectional shape.

* * * * *